United States Patent [19]

Dzus, Jr.

[11] 4,133,142

[45] Jan. 9, 1979

[54] LATCH

[75] Inventor: Theodore Dzus, Jr., Islip, N.Y.

[73] Assignee: Dzus Fastener Co., Inc., West Islip, N.Y.

[21] Appl. No.: 840,835

[22] Filed: Oct. 11, 1977

[51] Int. Cl.[2] ..... E05F 1/00

[52] U.S. Cl. ..... 49/379; 292/19; 292/254; 292/DIG. 37; 49/394; 49/386

[58] Field of Search ..... 49/379, 394, 386; 254/19, DIG. 80, 254

[56] References Cited

U.S. PATENT DOCUMENTS

| | | | |
|---|---|---|---|
| 780,417 | 1/1905 | Euphrat | 292/19 |
| 1,107,352 | 8/1914 | Pugh | 49/379 X |
| 2,506,846 | 5/1950 | Teasdale | 292/19 X |

*Primary Examiner*—Kenneth Downey

*Attorney, Agent, or Firm*—Kane, Dalsimer, Kane, Sullivan, & Kurucz

[57] ABSTRACT

A latch for releasably holding two members together. The latch includes a stud adapted to be mounted in fixed position on one of the members and a receptacle adapted to be mounted in fixed position on the other of the members and located to engage with the stud when the members are brought together. A coupling on the stud and receptacle automatically couples and holds the two members together. A release on the stud and receptacle which is exposed for actuation acts to uncouple the latch and permit the members to be separated. The coupling includes at least one flanged finger on the stud resiliently displaceable and a fixed rim on the receptacle so that when the stud and receptacle are engaged the flanged finger will displace and engage the rim to close the latch. The release includes a surface to direct the resilient finger away from engagement with the rim and release the latch when the release is actuated.

5 Claims, 8 Drawing Figures

FIG.1
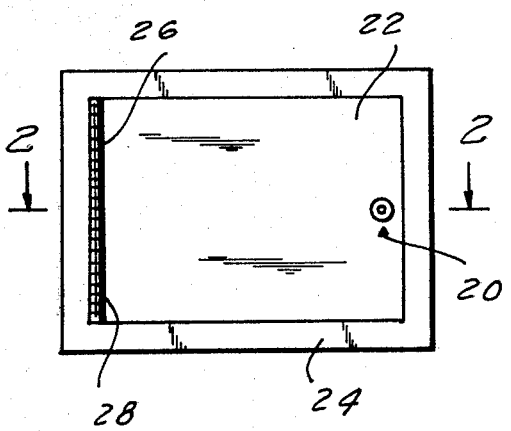
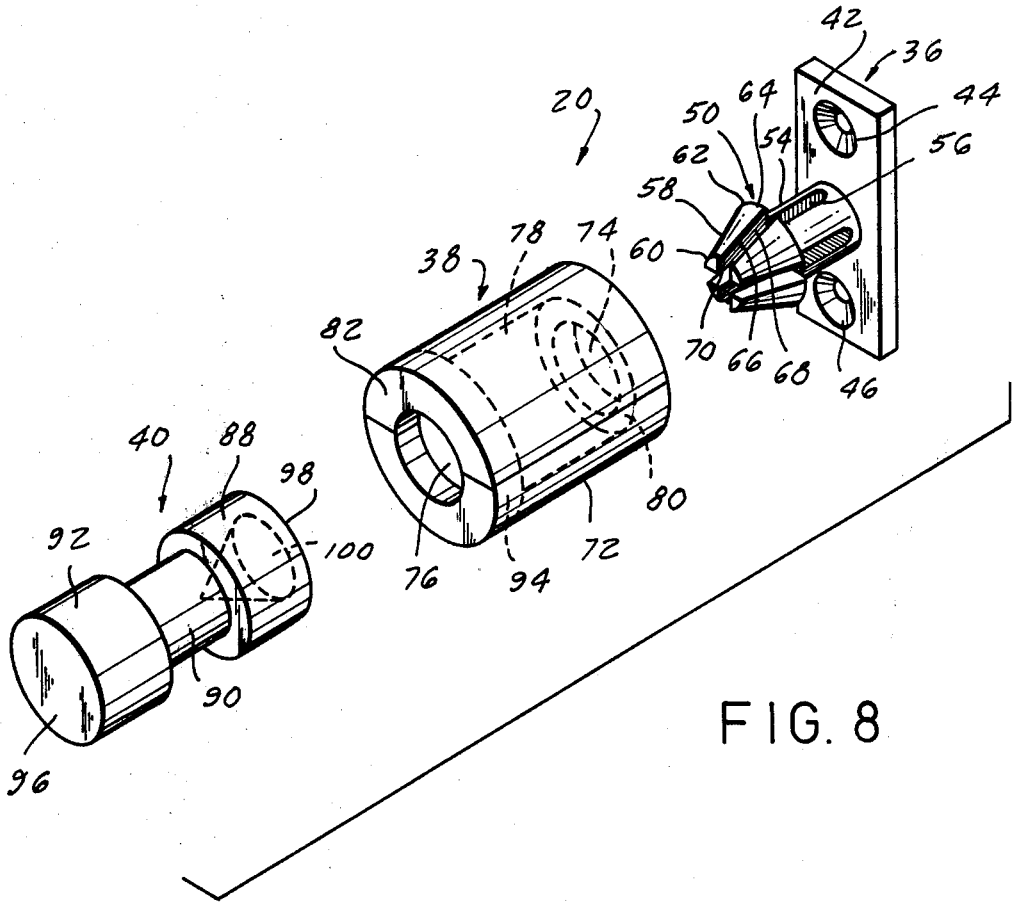
FIG. 8

FIG. 4
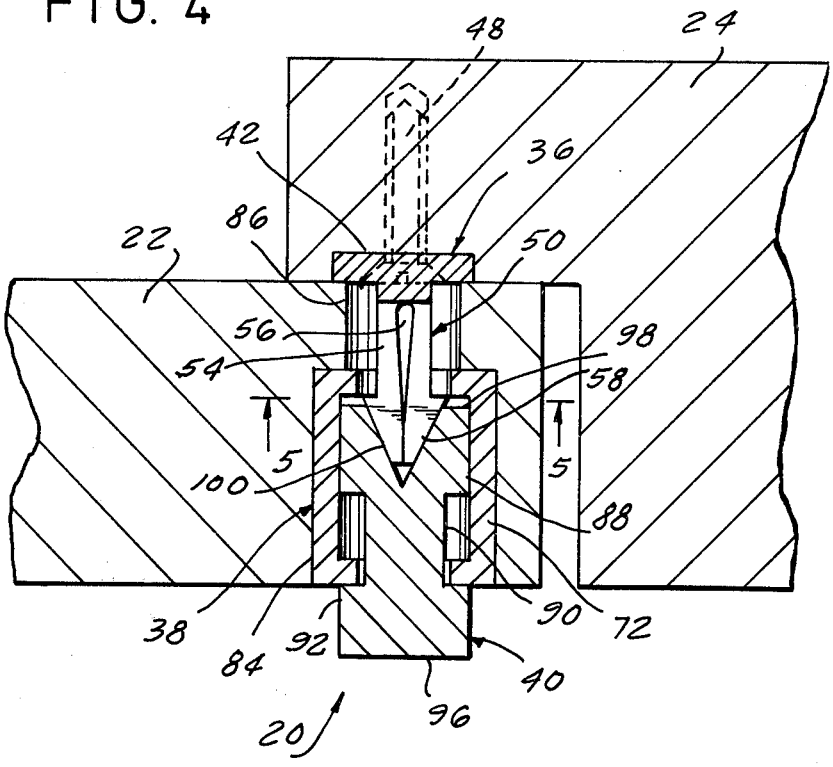
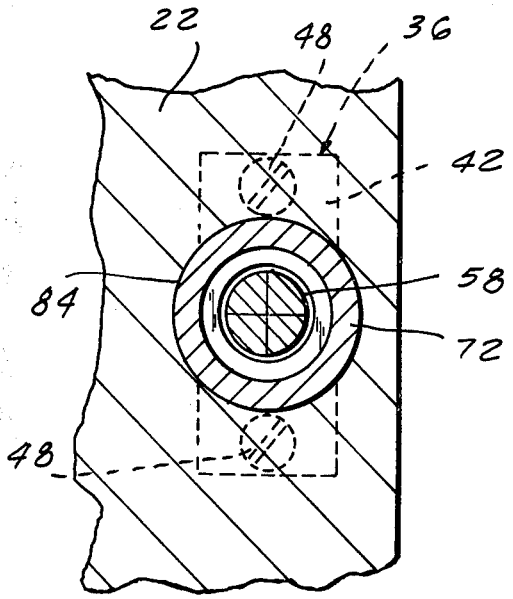
FIG. 5

FIG. 6
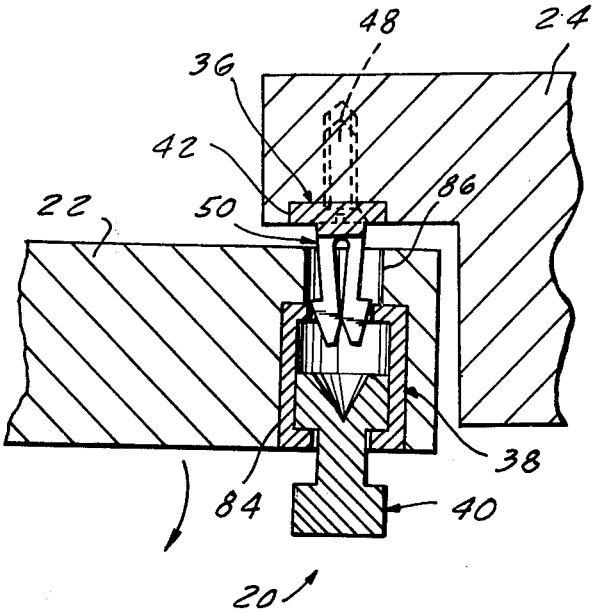
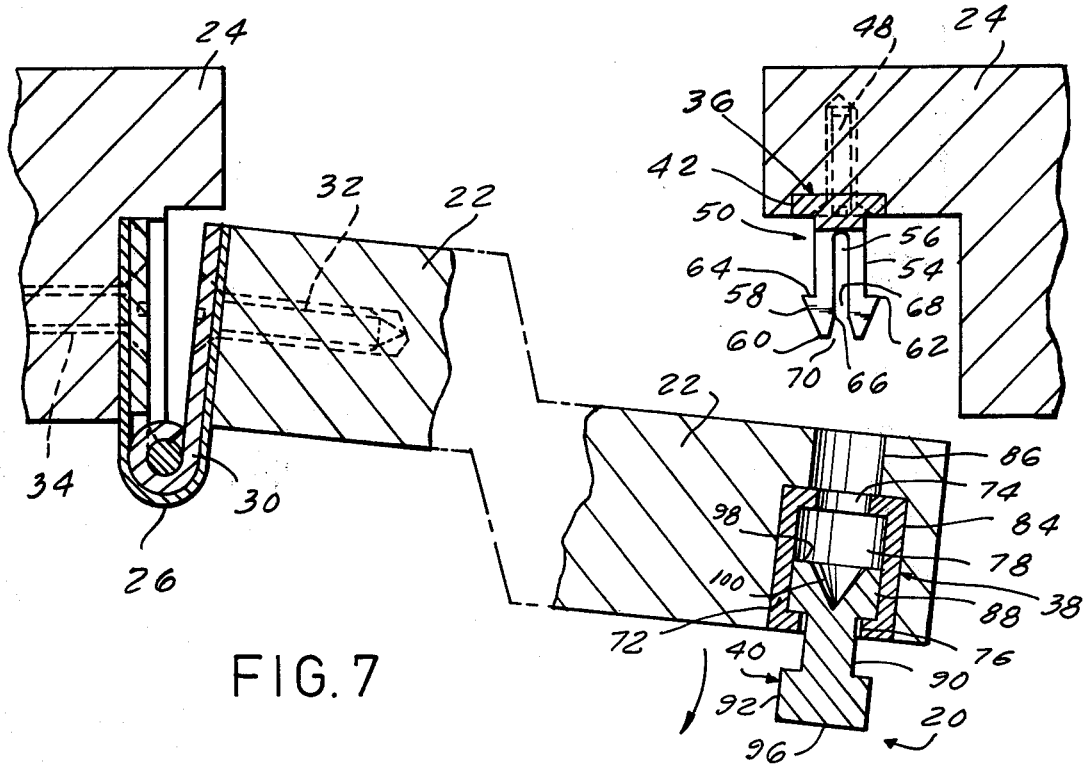
FIG. 7

LATCH

BACKGROUND OF THE INVENTION

There are many different types of door latches available and they employ a variety of different type release mechanisms to open the door and gain access to an interior space. In certain environments, the door must be open and shut frequently particularly where time is of the essense and the person involved needs to quickly and frequently get to the interior of the compartment and then release the compartment without significant interference with further work efforts. For example, this need occurs in kitchen or airplane use where cabinets are commonly used for storage purposes. The kitchen or airline worker often has to open compartments to get materials for storage or service purposes. Accordingly, latch mechanisms which are difficult and time consuming to operate result in an undesirable waste of time.

Accordingly, there is a need for a quick operating, positive latch mechanism which can be quickly and efficiently opened to permit access to the interior of the compartment and then which can be easily reclosed.

SUMMARY OF THE INVENTION

With the above background in mind, it is among the primary objective of the present invention to provide a door latch which is simple in construction, efficient to operate and economic to produce. The latch is designed so that it can be easily mounted to existing door and frame arrangement and can be formed of a few simple component parts. A resilient stud is provided with at least one resilient finger having a head on one end shaped to facilitate its introduction and engagement with a receptacle having a receiving rim to hold the latch automatically when the fingers are inserted therein. A release plunger assembly is positioned so that it extends from the receptacle and stud arrangement and can be directed against the fingers to displace them from engagement with the receptacle and permit the automatic separation of the receptacle from the stud. Thus, when the stud is mounted on one of a support frame and door and the receptacle is mounted on the other of the support frame and door, a simple and effective latch mechanism is provided. The plunger assembly has an extending button portion which can be depressed in one motion to open the latch. To assist in the separation of the stud and receptacle, a spring can be provided as part of the latch or as part of the door and frame arrangement to direct the receptacle from the stud when the release button has been depressed. Latching is automatic when the door is closed and the door will immediately open upon depression of the release button thus providing for a quick acting, efficient and simple latch mechanism for a door and frame arrangement.

In summary, a latch is provided for releasably holding two members together. The latch includes a stud adapted to be mounted in fixed position on one of the members and a receptacle adapted to be mounted in fixed position on the other of the members and located to engage with the stud when the members are brought together. Coupling means is on the stud and receptacle to automatically couple and hold the two members together. Release means is on the stud and receptacle and exposed for actuation to uncouple the latch and permit the members to be separated. The coupling means includes at least one flanged finger on one of the stud and receptacle and resiliently displaceable and a fixed rim on the other of the receptacle and stud so that when the stud and receptacle are engaged the flanged finger will displace and engage the rim to close the latch. The release means includes a surface to direct the resilient finger away from engagement with the rim and release the latch when the release means is actuated.

With the above objectives among others in mind, reference is made to the attached drawings.

BRIEF DESCRIPTION OF THE DRAWINGS

In The Drawings

FIG. 1 is a side elevation view of a door and frame arrangement with the latch of the invention mounted thereof;

FIG. 4 is a fragmentary sectional top view thereof showing the release button depressed and the latch in position for the door to open;

FIG. 5 is a fragmentary sectional elevation view thereof taken along the plane of line 5—5 of FIG. 4;

FIG. 6 is a fragmentary top sectional view thereof showing the door being opened in the direction of the arrow;

FIG. 7 is a fragmentary sectional top view thereof showing the door having been further opened in the direction of the arrow and the latch parts fully separated; and FIG. 8 is an exploded perspective view of the latch of the invention.

DETAILED DESCRIPTION

Figure 2:
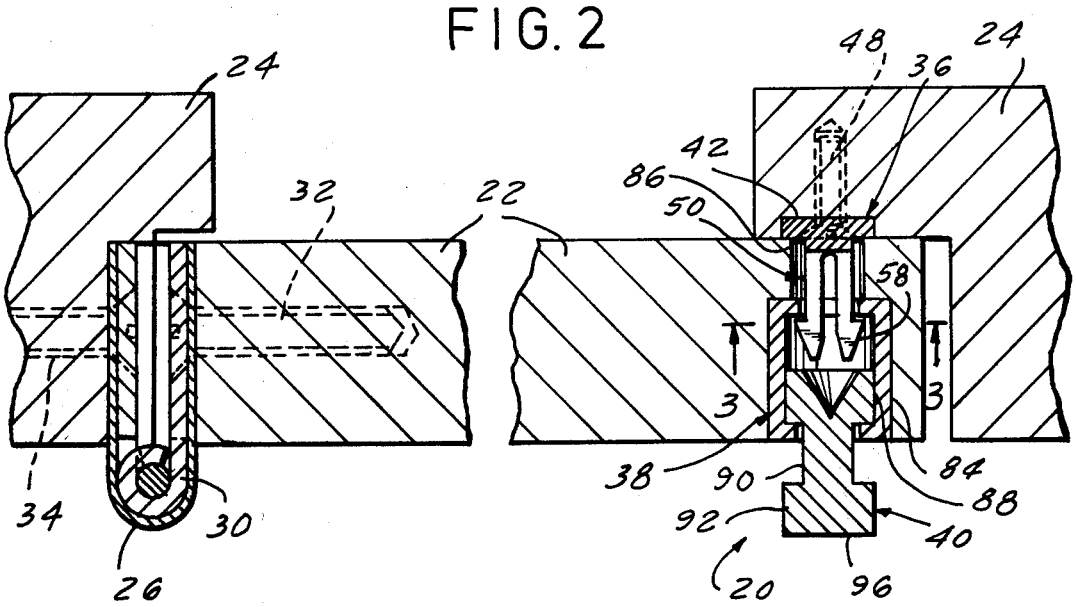
FIG. 2 is a fragmentary sectional top view thereof taken along the plane of line 2—2 of FIG. 1 and showing the latch in the closed position.
Figure 3:
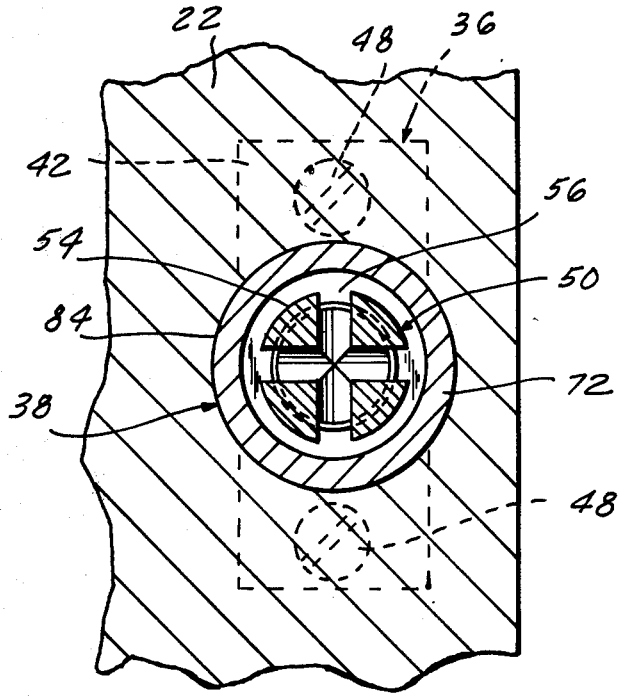
FIG. 3 is a fragmentary sectional elevation view thereof taken along the plane of line 3—3 of FIG. 2.

Door latch 20 is depicted in FIG. 1 mounted to a conventional door 22 such as that used for storage on an airplane of other convenient location to close a compartment. The door 22 is mounted to a fixed frame 24 surrounding the opening to the compartment. Door 22 is mounted to frame 24 by means of a conventional pair of spring hinges 26 and 28 with each hinge, as shown in FIG. 2, including a spring 30 thereon and affixed respectively to the door 22 and frame 24 by use of screws 32 and 34. Alternatively, in place of the springs as part of hinges 26 and 28, the spring mechanism can be formed as part of the latch 20.

The components of latch 20 are depicted independent of the door and frame in FIG. 8. The latch assembly includes a stud assembly 36, a receptacle assembly 38, and a plunger assembly 40.

Stud assembly 36 includes a rectangular base plate 42 with a pair of spaced apertures 44 and 46 for mounting the stud assembly to door frame 24 by means of appropriate screws 48 as shown in FIGS. 2–7.

Extending substantially perpendicular from the surface of plate 42 is an arrangement of flanged fingers which together form a stud 50. Each finger 52 is formed of a substantially rigid but somewhat flexible material such as a relatively stiff plastic or nylon. The number of fingers 54 is a matter of choice with four fingers being depicted in the presently discussed embodiment. Furthermore, in the present embodiment, all of the fingers 54 have the same configuration so that they mate when flexed to be brought into engagement at their free ends. In normal relaxed position the fingers are separated and each finger 54 is formed with an elongated rectangular stem 56 extending from the base plate 42 to an enlarged head 58 at its free end. The fingers can be individually formed or integrally formed as shown and can be mounted to the base in any conventional fashion or formed as an integral part of the base plate 42.

Each head 58 has an arcuate outer surface and is fustroconical in configuration so that it tapers from a smaller tip 60 to a larger rear end 62. The rear end 62 ends in a lateral shoulder 64 which extends into integral connection with elongated stem 56.

The terminal edges 66 of the arcuate outer surface of head 58 extend into an inwardly tapering flat surface 68. Each pair of flat surfaces 68 on a head 58 merge at an inner common edge 70. The inner common edge 70 extends along the length of the head 58. With each head 58 being formed with the same configuration, when the heads are directed together by resiliently displacing the fingers 52 inwardly, the flat surfaces 66 will mate along with rear shoulders 64 to form a complete fustroconical head for the stud 50 with a reduced tip formed by the four tips 60 and an arcuate continuous shoulder 64 at the rear end of the heads. When released, the fingers will resiliently return to their initial configuration with the heads and fingers being separated in the configuration as depicted in FIG. 8.

Receptacle 38 is in the form of a hollow cylindrical body 72 having an opening 74 in one end and an opening 76 in the other end to provide access to the interior hollow chamber 78 of the receptacle. The diameter of opening 74 is less than the outer diameter of cylindrical body 72 thus forming an annular rim 76 on the inner surface of receptacle 38 adjacent to opening 74. Similarly, the diameter of opening 76 at the other end of body 72 is less than the outer diameter of the body thus forming a shoulder 82 at the opposite end of the receptacle.

Receptacle 38 can be formed of one or more pieces and in the embodiment shown as a pair of mating halves which is adapted to be mounted in a receiving recess 84 in door 22 as depicted in FIGS. 2–7. The recess 84 is a larger diameter portion of a through passageway in the door 22 which also has a reduced diameter portion 86 adjacent to the adjacent portion of door frame 24.

The third component of latch 20 is plunger assembly 40 which has a plunger head 88 on one end, an intermediate plunger rod 90 of lesser outer diameter and a button 92 of larger diameter than the rod on the end of rod 90 opposite to plunger head 88. Plunger assembly 40 can be formed of one or more components with the decision being a matter of choice. In the depicted embodiment, plunger assembly 40 is formed of one integral piece and receptacle 38 is formed of two mating halves so that the plunger head 88 can be received within chamber 78 and then captured therein by engaging the two halves of receptacle 38 together. The outer diameter of plunger head 88 is larger than opening 76 as is the outer diameter of button 92. In contrast, the outer diameter of plunger stem 90 is less than the diameter of opening 76 thus the plunger assembly 40 can be reciprocally shifted within chamber 78 of receptacle 38 the distance between the plunger head 88 and the button 92. Movement in one direction is restricted by engagement between plunger head 88 and shoulder 82 in the receptacle and in the other direction by engagement between button 92 and the exposed rear surface 94 of receptacle 38. The outer diameter of head 88 is less than the inner diameter of chamber 78 to permit reciprocation thereon. There are alternative ways of constructing receptacle 38 and plunger assembly 40 so that they can be assembled other than that described above which are conventional well known construction methods. The components of latch 20 with the exception of stud 50 can be formed of conventional rigid metal or plastic components. Flexibility is only necessary with respect to the fingers of stud 50.

The exposed end surface 96 of button 92 forms a finger depressing surface for actuation of the plunger assembly to act as a release means. To cooperate therewith, the exposed leading surface 98 of plunger head 88 is formed with a conical recess 100 for engagement with the fingers of stud 36 to shift the fingers into the released position when the button 92 is depressed.

In use, stud assembly 36 is mounted to door frame 24 by use of screws 48 on base plate 42. A through passageway in alignment with stud assembly 36 is formed in door 22 and includes narrower diameter portion 86 and wider diameter portion 84. Mounted in wider diameter portion 84 is assembled receptacle 38 and plunger assembly 40. The receptacle can be mounted in any conventional fashion such as by a suitable bonding agent or by appropriate fasteners such as screws and the like. In the mounted position button 92 extends outwardly from the door 22 in exposed position for manual access and actuation. In the inactive condition, the button 92 and the majority of plunger rod 90 are exposed outwardly of the door with the rear surface of plunger head 88 in engagement with shoulder 82 in the receptacle as depicted in FIG. 2. This position can be maintained by a slight frictional engagement or distribution of weight or by use of a suitable spring in a convenient location such as in surrounding position about rod 90 and engaging with the undersurface of button 92 and the exposed outer surface of receptacle 38.

When the door is closed the exposed surfaces of the forward end of receptacle 30 surrounding opening 78 will engage with the outer arcuate surfaces of heads 58 depressing the fingers inwardly toward one another until the finger heads 58 extend fully within chamber 78 whereupon the fingers will resiliently return to their expanded position with shoulders 64 forming a stop surface with rim 80 on the interior of receptacle 38. In this condition, as depicted in FIG. 2, the door will be in the latched or closed condition.

To open the door, as depicted in FIG. 4, surface 96 of button 92 is depressed bringing conical aperture 100 in plunger head 88 into engagement with the heads 58 of the fingers. The tapered fustroconical surfaces on the heads 58 will engage with the surface of conical aperture 100 and be directed toward one another until shoulders 64 are free from alignment with rim 80 as shown in FIG. 4. The biased springs 30 in spring hinges 26 and 28 will then tend to open door 22 and shift receptacle 38 away from stud assembly 36 and withdraw the depressed fingers back out through opening 74. This procedure is depicted in FIG. 6. It should be noted that once the heads 58 have been depressed sufficiently toward one another to free them from engagement with rim 80, the button 96 can be released since the spring hinges will automatically begin to open the door without further manual actuation being required. The door will continue to be opened under the force of the spring hinges until stud assembly 36 is completely free of receptacle 38 and aperture portion 86 in the door thus completely opening the latch and the door for access to the interior of the compartment. The door can be reclosed in the same manner by merely applying force to the door in the closing direction against the force of springs 30 in door hinges 26 and 28 until the latch automatically returns to the closed position as depicted in FIG. 2. In this manner, the door can be quickly opened and closed in rapid succession as many times as desired.

In place of locating the spring in the hinges 26 and 28, a conventional spring arrangement can be employed as part of the latch to direct the receptacle and stud assembly away from one another when the fingers have been shifted to the open position. For example, a coiled helical spring can be mounted about the stud fingers 50 for engagement with the adjacent surface of the door to direct the door way from the stud assembly when the stud fingers are free from engagement with the receptacle by a simple depression of a button 92.

Alternative embodiments can be readily envisioned such as where the stud is mounted on the door and the receptacle in the door frame.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A latch for releasably holding two members together comprising; a stud adapted to be mounted in fixed position on one of the members, a receptacle adapted to be mounted in fixed position on the other of the members and located to engage with the stud when the members are brought together, coupling means on the stud and receptacle to automatically couple and hold the two members together, release means on the stud and receptacle and exposed for actuation to uncouple the latch and permit the members to be separated, the coupling means including at least one flanged finger on one of the stud and receptacle and resiliently displaceable and a fixed rim on the other of the stud and receptacle so that when the stud and receptacle are engaged the flanged finger will displace and engage the rim to close the latch, the release means including a surface to direct the resilient finger away from engagement with the rim and release the latch when the release means is actuated, the at least one resilient finger being on the stud and the stud being mounted on a door frame, the receptacle being in the form of a cup having an annular rim adjacent an open end, the receptacle being mounted on the door in fixed position so that when the door is closed the resilient finger will be resiliently displaced by engagement with the cup as it passes through the opening therein until it can resiliently shift into engagement with the rim adjacent the opening of the cup, the release means being in the form of a plunger assembly with a reduced diameter portion extending through a second opening in the cup-shaped receptacle and a larger head portion captured within the receptacle and shiftable into and out of engagement with the resilient finger so as to displace the resilient finger from engagement with the rim and permit the finger to be removed from the receptacle and the door to be opened, the reduced diameter portion extending through the opening terminating in an exposed button adapted to be manually displaceable to cause the plunger head to release the resilient finger from engagement with the rim, the at least one resilient finger including four resilient fingers extending from a base plate, the base plate adapted to be mounted to the support, each finger having a resilient stem portion terminating in a flanged head, the outer configuration of the head being fustroconical in configuration and the end of the head adjacent the stem forming a shoulder, each head tapering outward from the free end to the end attached to the stem, the four fingers having mating heads to form a fustroconical tip having a narrow diameter free end and a larger diameter end forming a shoulder in engagement with the spaced stems of the fingers, the resilient fingers being normally positioned with their heads in spaced relationship and adapted to be resiliently deformed so that the heads of the fingers are brought into engagement, the heads being spaced so that insertion of the fingers into the opening in the end of the receptacle will cause the tapered heads to be directed toward one another until the heads pass through the opening in the cup whereupon the resilient fingers will cause the heads to separate and the shoulders on the underside of each head will engage with the rim of the receptacle to automatically retain the heads in the receptacle and thereby close the latch.

2. The invention in accordance with claim 1 wherein the plunger head has a conical recess therein so that when the plunger is engaged with the finger heads the heads will be directed toward one another to free the fingers from engagement with the receptacle.

3. The invention in accordance with claim 1 wherein spring means is provided to direct the door from the support when the release means is actuated and the stud is free for displacemnt from engagement with the receptacle.

4. The invention in accordance with claim 3 wherein the spring means is in the form of at least one spring hinge mounting the door to the frame and biased when the latch is closed so that when the release means is actuated the biased spring hinge will force the door away from the support and free the stud from the receptacle.

5. A latch for releasably holding two members together comprising; a stud adapted to be mounted in fixed position one one of the members, a receptacle adapted to be mounted in fixed position on the other of the members and located to engage with the stud when the members are brought together, coupling means on the stud and receptacle to automatically couple and hold the two members together, release means on the stud and receptacle exposed for actuation to uncouple the latch and permit the members to be separated, the coupling means including at least one flanged finger on one of the stud and receptacle and resiliently displaceable and a fixed rim on the other of the stud and receptacle so that when the stud and receptacle are engaged the flanged finger will displace and engage the rim to close the latch, and the release means including a surface to direct the resilient finger away from engagement with the rim and release the latch when the release means is actuated, the two members being a door and a door frame, the at least one resilient finger being on the stud, the receptacle being in the form of a cup having an annular rim adjacent an open end, the receptacle being mounted in fixed position so that when the door is closed the resilient finger will be resiliently displaced by engagement with the cup as it passes through the opening therein until it can resiliently shift into engagement with the rim adjacent the opening of the cup, the release means being in the form of a plunger assembly with a reduced diameter portion extending through a second opening in the cup shaped receptacle and a larger head portion captured within the receptacle and shiftable into and out of engagement with the resilient finger so as to displace the resilient finger from engagement with the rim and permit the finger to be removed from the receptacle and the door to be opened, a reduced diameter portion extending through the opening terminating in an exposed button adapted to be manually displaceable to cause the plunger head to release the resilient finger from engagement with the rim, a plurality of resilient fingers extending from a base plate, the base plate adapted to be mounted to the support, each finger having a resilient stem portion terminating in a flanged head, the outer configuration of the head being fustroconical in configuration and the end of the head adjacent the stem forming a shoulder, each head tapering outward from the free end to the end attached to the stem, the fingers having mating heads to form a fustroconical tip having a narrow diameter free end and a larger diameter end forming a shoulder in engagement with the spaced stems of the fingers, the resilient fingers being normally positioned with their heads in spaced relationship and adapted to be resiliently deformed so that the heads of the fingers are brought into engagement, the heads being spaced so that insertion of the fingers into the opening in the end of the receptacle will cause the tapered heads to be directed toward one another until the heads pass through the opening in the cup whereupon the resilient fingers will cause the heads to separate and the shoulders on the underside of each head will engage with the rim of the receptacle to automatically retain the heads in the receptacle and thereby close the latch.

* * * * *